United States Patent [19]

Spicer

[11] 4,032,774

[45] June 28, 1977

[54] SNAP-TOGETHER LIGHT FIXTURE

[76] Inventor: Edward Spicer, 11631 Don Alicia Place, Studio City, Calif. 91604

[22] Filed: June 25, 1976

[21] Appl. No.: 699,947

[52] U.S. Cl. ..... 240/73 LD; 240/73 QD; 240/78 CF

[51] Int. Cl.[2] ..... F21S 1/02; F21S 3/02; F21S 5/00

[58] Field of Search ..... 240/52 R, 52.1, 73 R, 240/73 LD, 73 QD, 153, 78 R, 78 CF, 78 H

[56] References Cited

UNITED STATES PATENTS

| | | | |
|---|---|---|---|
| 997,598 | 7/1911 | Both | 240/153 X |
| 2,076,020 | 4/1937 | Fraser | 240/73 R X |
| 2,465,753 | 3/1949 | Ross | 240/52.1 X |
| 3,126,159 | 3/1964 | Verrone | 240/73 R |

FOREIGN PATENTS OR APPLICATIONS

| | | | |
|---|---|---|---|
| 96,973 | 5/1898 | Germany | 240/73 QD |

*Primary Examiner*—John Gonzales

[57] ABSTRACT

A snap-together light fixture including a bulb receiving socket having associated spring means for releasably locking the socket in a support, a metal cup for receiving and enclosing the socket, and a base member adapted to fit upon a wall or ceiling, the cup and base member cooperatively supporting the socket by means of openings through which the socket extends, while the spring means of the socket releasably grasps the edges of the openings for holding all three parts together.

5 Claims, 11 Drawing Figures

W
10
15
F'
C
16
B
L
-J-
50
52
54
30
12
22
33
S
17
23
53
13
55
25
F''
C3
B'
C2
C1
L3
L2
L1

SNAP-TOGETHER LIGHT FIXTURE

BACKGROUND OF THE INVENTION

In manufacturing light fixtures it is essential to maintain the artistic appearance of the product as well as its operational capability. Each light fixture includes a number of mechanical parts which are manufactured separately. Within the context of the present technology it has been necessary to permanently fasten the various parts of the fixture together, by means of fastening screws, or solder connections, or the like.

It has therefore been an accepted fact in this industry that substantial labor costs must be paid for the work of fastening the parts of each fixture together, as the fixture in being assembled.

SUMMARY OF THE INVENTION

According to the present invention a releaseable spring means is utilized for fastening all the mechanical parts of a light fixture together. The more time-consuming procedures required for soldering the parts together, or for fastening them with screws, are eliminated.

According to the invention a bulb socket having spring means for releasably fastening the socket to a support, is utilized in conjunction with a metal pin or base member, and a metal cup, to provide a complete light fixture. Holes are formed through the base member and through the bottom wall of the cup, and the cup and base member are placed in juxtaposition with the holes aligned. The base end of the socket is then inserted within the holes, and the expanding spring means associated with the socket is engaged with the circumferential edges of the holes or openings so as to hold all three of the parts together.

DRAWING SUMMARY

FIRST EMBODIMENT

Reference is now made to FIG. 1–8, inclusive, of the drawings which illustrate a first embodiment of the invention.

Figure 1:
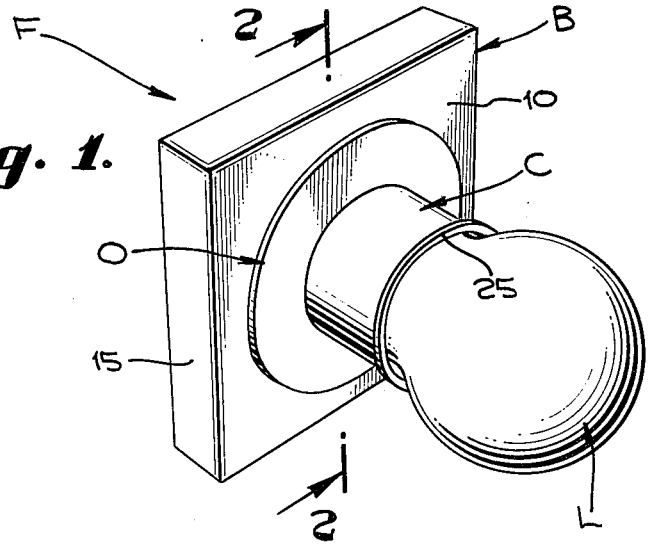
FIG. 1 is a perspective view of a snap-together light fixture in accordance with the invention.
Figure 2:
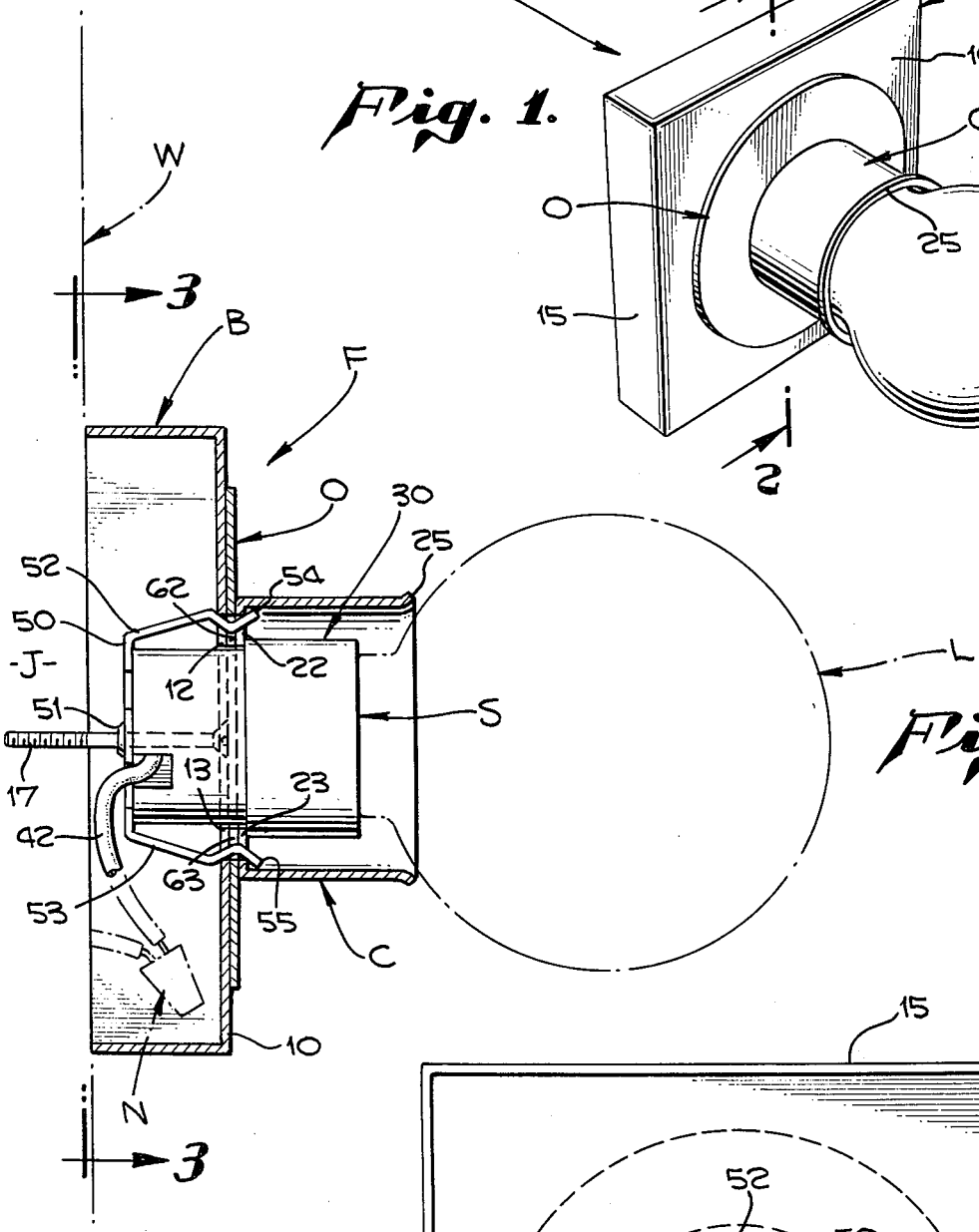
FIG. 2 is a cross-sectional elevation view taken on line 2—2 of FIG. 1.
Figure 3:
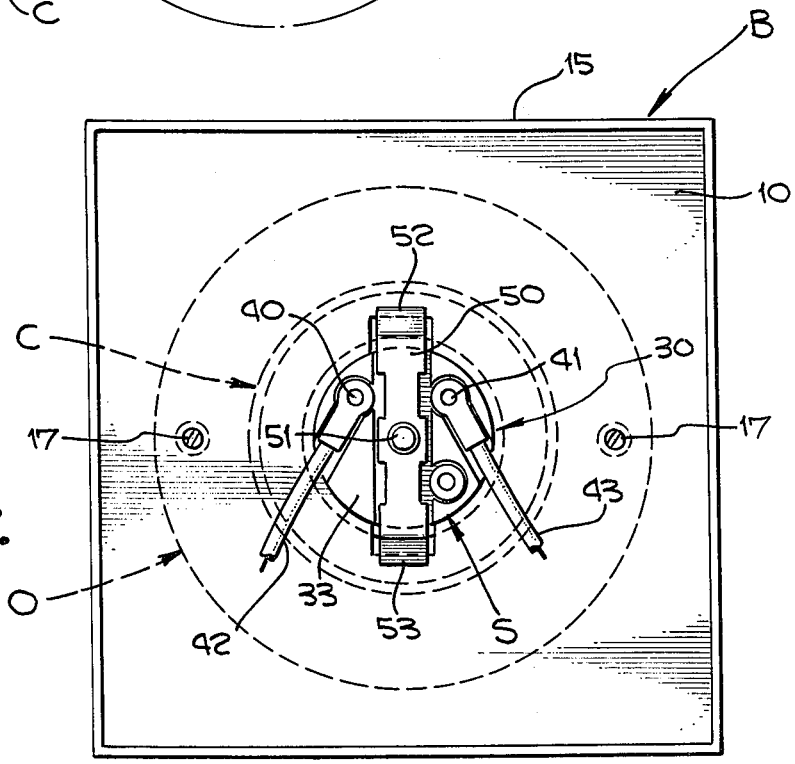
FIG. 3 is a rear elevation view taken on line 3—3 of FIG. 2.

As best seen in FIG. 2, fixture F in accordance with the invention is adapted to be mounted upon a wall or ceiling W and covering a junction box J. Location of the junction box is indicated in FIG. 2, but the details of its construction which are conventional and well-known are not shown. The major component parts of the light fixture F are a base member or pan B, a metal cup C, a bulb socket S, and an ornamental plate O. A light bulb L, shown in FIG. 2 in dotted lines, is shown in solid lines in FIG. 1.

In the fully assembled condition of light fixture F, and with the light bulb L in place as shown in FIG. 1, the bulb socket S is hidden from view. However, the bulb socket S is the central structural member of the entire fixture, and it will therefore be described in some detail before proceeding to a detailed description of the other parts.

Reference is now made to FIGS. 2–5 and 7, 8 which illustrate the bulb socket S. The bulb socket S includes a generally cylindrical socket body 30, a pair of electrical terminals 40, 41, and a spring steel strap 50. Terminals 40, 41 are shown only in FIG. 3. The socket body 30 has a bulb-receiving end 31 which is open and in which internal threads 32 are formed. The other or base end 33 is substantially closed and has the terminals 40, 41 attached to it. For about half its length the socket body 30 has a reduced external diameter portion 34 which terminates at the base end 33, thereby forming a circumferential shoulder 35 which is about mid-way of the length of the socket body.

Spring steel strap 50 is of generally U-shaped configuration but with its legs 52, 53 being somewhat outwardly expanded. The central or base portion of strap 50 extends across the base end 33 of socket body 30 and is attached there by means of a central rivet 51. Therefore, the legs of the spring steel strap extend along the sides of socket body 30 and toward the open end 31 thereof, but terminating at about the position of the circumferential shoulder 35. The ends of the spring legs 52, 53 are bent to form hooks 54, 55, respectively, which opens outward and whose longitudinal position coincides rather precisely with that of the circumferential shoulder 35.

Wires 42, 43 are connected to the electrical terminals 40, 41, respectively. In the installed condition of the fixture, as shown in FIG. 2, wire nuts N are used to attach the wires 42, 43 to respective leads emanating from junction box J.

The bulb socket S is a conventional product which has been known and used prior to the present invention, and hence the socket S does not, in and of itself, constitute the invention. However, in accordance with the present invention the socket S, and particularly the spring means 50 thereof, is utilized in a novel manner for holding the various parts of fixture F together, in lieu of other fastening means.

The metal cup C is of generally configuration but with a bottom wall 20 extending transversely at one end thereof. A concentric circular opening 21 is formed in the bottom wall 20 (see FIG. 6). An opposed pair of rectangular cutouts 22, 23 are formed in the bottom wall 20 as circumferential extensions of the opening 21. The open end of cup C is outwardly flared.

Figure 5:
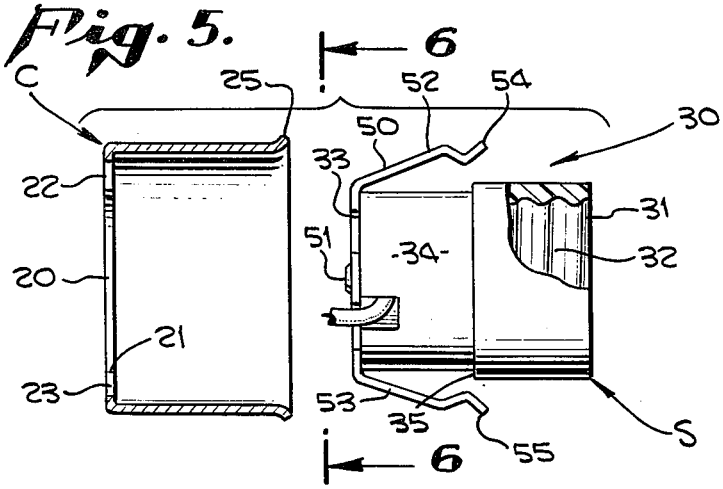
FIG. 5 is a side view, partially in cross-section, of the bulb socket and the cup before they are assembled together.
Figure 6:
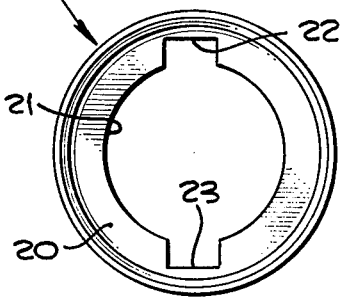
FIG. 6 is an end view of the cup taken on line 6—6 of FIG. 5.
Figure 4:
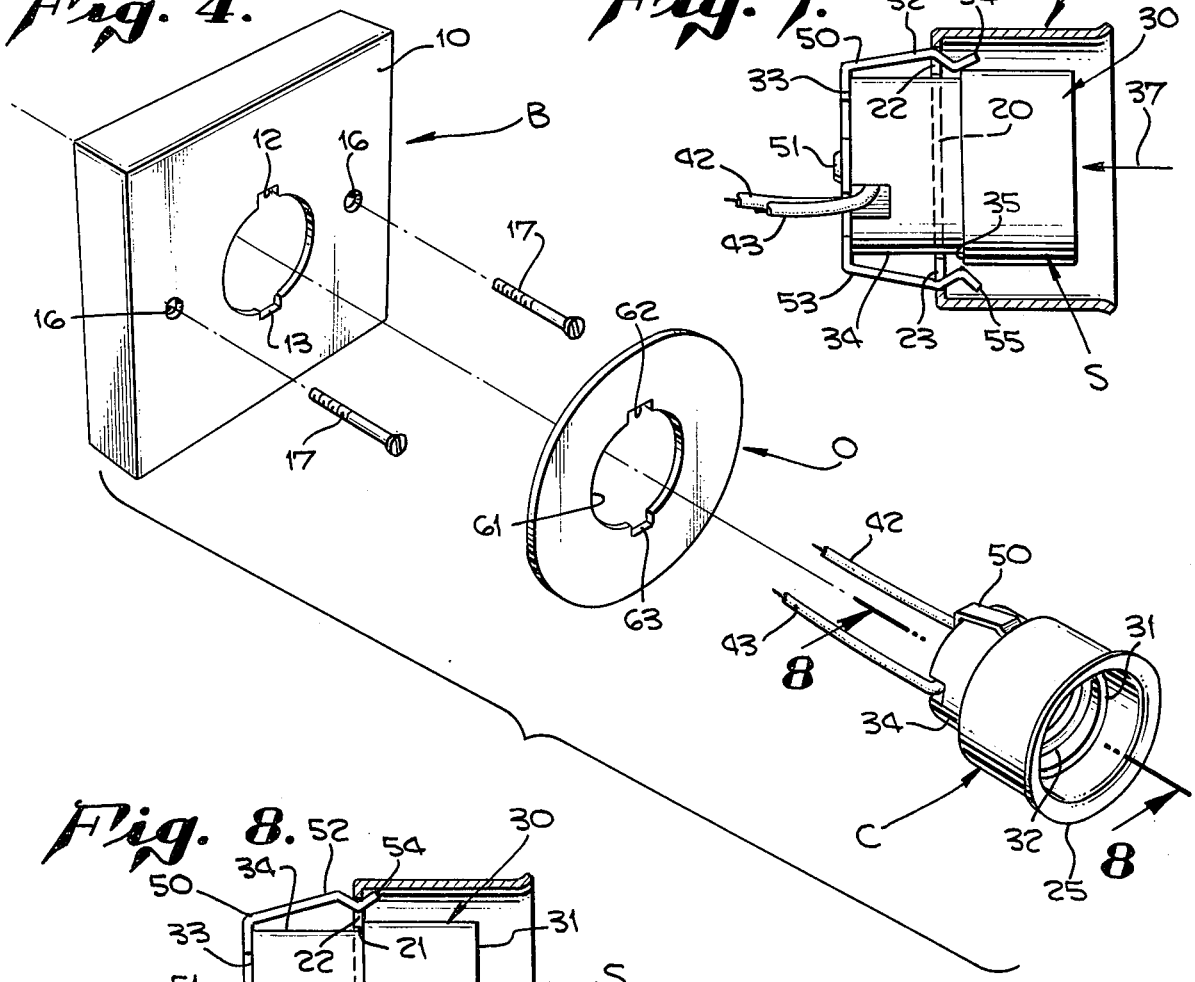
FIG. 4 is an exploded perspective view of the light fixture of FIG. 1.
Figure 7:
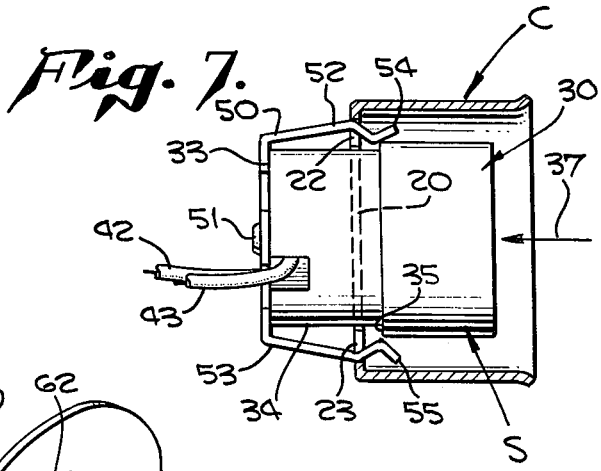
FIG. 7 is a side view, partially in cross-section, of the bulb socket and cup as they are being assembled.
Figure 8:
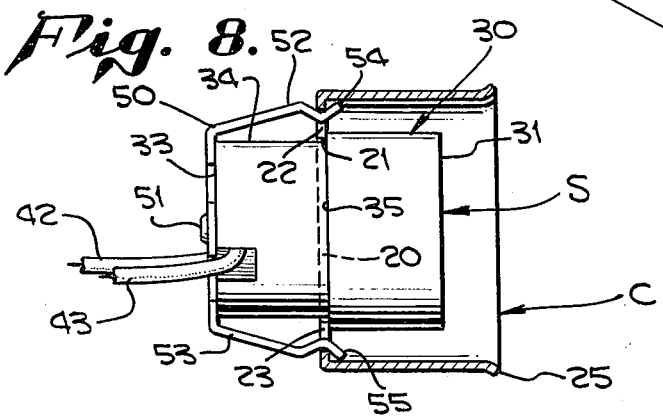
FIG. 8 is a view like FIG. 7 showing completion of the assembly.

In order to assemble the complete fixture F together it is preferred to first assemble the bulb socket S and metal cup C. The progressive steps of the assembly are shown in FIGS. 5, 7, and 8, respectively. The reduced diameter portion 34 of socket body 30 is inserted into the open end 25 of cup C, and hence into and through the circular opening 21 of bottom wall 20. In the nearly assembled condition as shown in FIG. 7 th circumferential shoulder 35 of socket body 30 has not yet come into engagement with the bottom wall 20 of cup C. The lateral extremities of the spring legs 52, 53 occupy the deepest portions of the rectangular cutouts 22, 23, respectively, while the inner or back surfaces of the hooks 54, 55 are very close to the circumferential shoulder 35. The assembly is completed by applying force to the open end 31 of socket body 30 in a direction towards the bottom wall 20 of cup C, while holding cup C in place. This force is indicated by arrow 37 in FIG. 7. The assembly is completed as shown in FIG. 8, with hooks 54, 55 then engaging the cutouts 22, 23, and with circumferential shoulder 35 engaging the inner surface of bottom wall 20 of the cup C.

Base member or pan B has a generally flat front wall 10 and a side wall 15. A circular opening 11 is formed in the wall 10 and has an opposed pair of rectangular cutouts 12, 13 formed in its periphery. See FIG. 4. A pair of small holes 16 are also formed in the front wall 10, on opposite sides of the opening 11, and screws 17 are utilized in conjunction with the holes 16 for attaching the base member to the junction box J and hence supporting it in a fixed position relative to wall or ceiling W.

The opening 11 and cutouts 12, 13 of base member B are of precisely the same dimensions as the opening 21 and cutouts 22, 23 of cup C. In the fully assembled state of fixture F (FIG. 2) the hooks 54, 55 engage cutouts 12, 13 as well as cutouts 22, 23, respectively.

The plate O is a relatively thin plate which has no particular mechanical function and is used only for ornamental or decorative purposes. It has a circular opening 61 in which cutouts 62, 63 are formed. The opening 61-63 is also of precisely the same dimensions as the opening 21-23. Ornamental plate O is positioned between cup C and base member B, and therefore in the assembled condition of fixture F the spring hook 54 engages cutouts 12, 62, and 22 while spring hook 55 engages cutouts 13, 63, and 23.

While base member B as presently illustrated has a square configuration, it may be circular or of such other shape as may be desired. Ornamental plate O as presently illustrated is circular, but it may be square or of other desired configuration. In the particular embodiment illustrated the diameter of plate O is sufficient to cover the head of screws 17 so that they are concealed from view.

MODIFIED FORM

Figures 9, 10, 11:
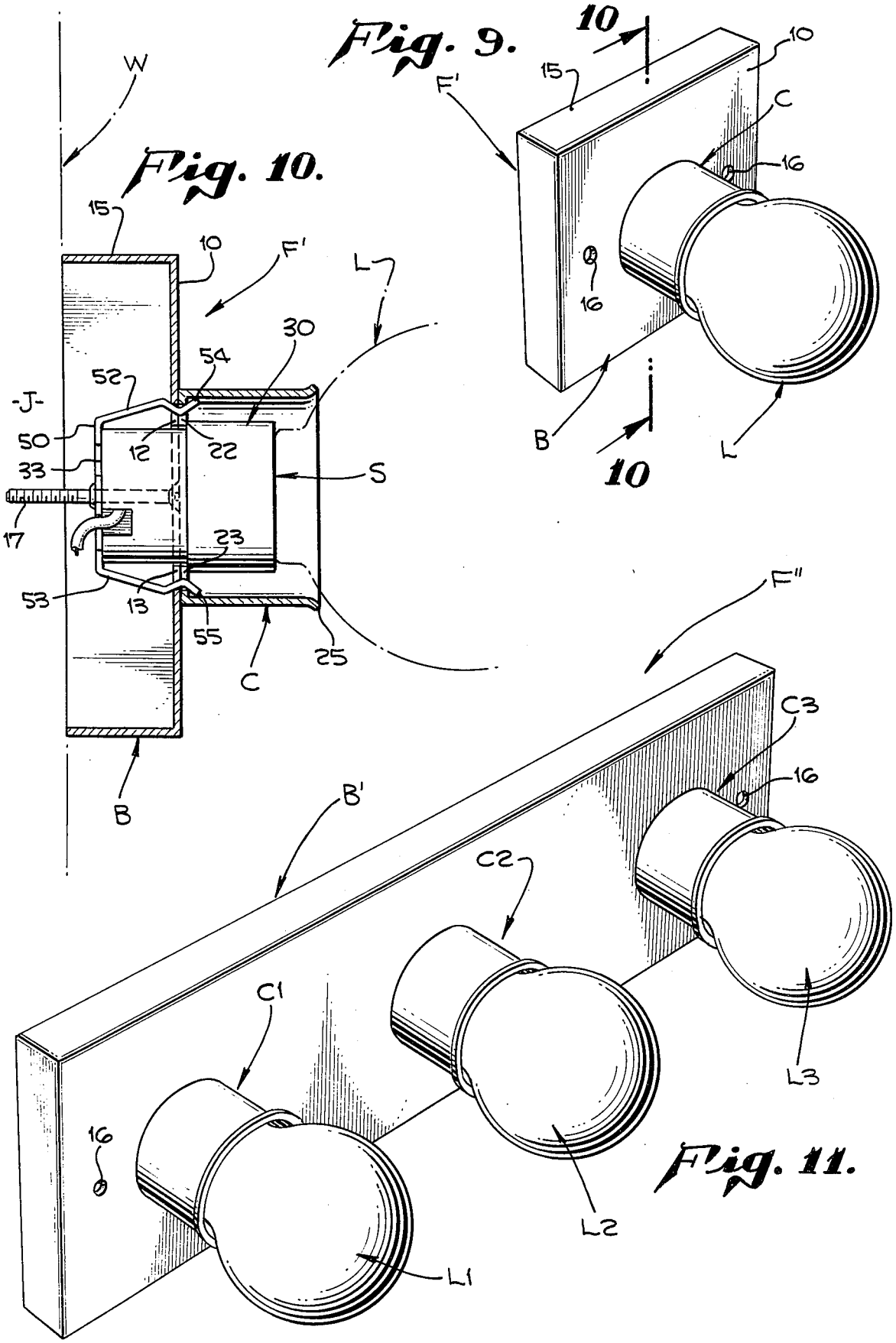
FIG. 9 is a perspective view of a modified form of light fixture in accordance with the invention.
FIG. 10 is a cross-sectional elevation view taken on the line 10—10 of FIG. 9.
FIG. 11 is a perspective view of a triple-bulb fixture in accordance with the invention.

Reference is now made to FIGS. 9 and 10 illustrating a modified form of the invention. Fixture F′ of FIGS. 9 and 10 is identical to fixture F, except that ornamental plate O is omitted, and the means for fastening base member B to walls W are not specifically illustrated.

ALTERNATE FORM

FIG. 11 illustrates an alternate form F″ of the light fixture of the present invention. Base member B′ may be of the same height as base member B of the first embodiment, but three times as wide, hence having the capacity for three bulb installations. A horizontal row of cans C1, C2, C3 house the light bulbs L1, L2, L3, respectively. The internal details of construction, while not specifically shown, are the same as for the first embodiment.

The invention has been described in considerable detail in order to comply with the patent laws by providng a full public disclosure of at least one of its forms. However, such detailed description is not intended in any way to limit the broad features or principles of the invention, or the scope of patent monopoly to be granted:

What is claimed is:

1. A snap-together light fixture comprising:

a wall or ceiling pan having a generally flat front wall, and having means for supporting said front wall in spaced relationship to a junction box;

a metal cup having an open top and a bottom wall, said bottom wall thereof being releasably supported by the front surface of said front wall of said pan;

said front wall of said pan and said bottom wall of said cup having formed therein congruent circular openings and congruent pairs of opposed cutouts in the circumferential edges of said openings;

a bulb socket having a generally cylindrical body, the bulb-receiving end of said body being open to form a socket and being internally threaded, and the base end of said socket body being closed and having a pair of electrical terminals thereon for energizing said socket and also having the central portion of a generally U-shaped spring steel strap attached thereto with the legs of said strap extending along the sides of said body and toward said open end thereof;

said open end of said socket body being received within said metal cup, said base end thereof having a reduced exterior diameter forming a circumferential shoulder about mid-way of the length of said socket body, said base end of said socket body extending through said congruent circular openings of said metal cup and pan wall therebeyond with said shoulder removably engaging the inner surface of said metal cup bottom wall; and the extremities of said strap legs having outwardly opening hooks formed therein, said strap legs being inwardly flexed and said hooks thereof engaging said cutouts of both said pan and said cup for securing the same to each other and said socket to them.

2. A light fixture as in claim 1 wherein said bottom end of said metal cup directly engages said pan wall.

3. A light fixture as in claim 1 which additionally includes an ornamental plate disposed between said pan front wall and said cup bottom end, and also having a congruent circular opening and opposed cutouts; said spring hooks securing said pan, plate, and cup together.

4. A snap-together light fixture including a bulb receiving socket having associated spring means for releasably locking the socket in a support, a metal cup for receiving and enclosing the socket, and a base member adapted to fit upon a wall or ceiling, the cup and base member cooperatively supporting the socket by means of openings through which the socket extends, while the spring means of the socket releasably grasps the edges of the openings for holding all three parts together.

5. A snap-together light fixture comprising:

a plurality of bulb-receiving sockets each having associated spring means for releaseably locking the socket in a support;

a plurality of metal cups for receiving and enclosing respective ones of said sockets, each of said cups having a bottom wall with a central opening therein; and a base member adapted to fit upon a wall or ceiling and having a plurality of openings therein for receiving respective ones of said sockets;

each of said cups having its bottom wall supported upon said base member with the central opening thereof aligned with a corresponding opening of said base member, the associated socket being disposed within said cup and extending through said aligned openings, and the spring means of the socket releasably grasping the edges of the openings for holding all three parts together.

* * * * *